US005649433A

United States Patent [19]

Suzuki et al.

[11] Patent Number: 5,649,433

[45] Date of Patent: Jul. 22, 1997

[54] COLD EVAPORATOR

[75] Inventors: Hiroaki Suzuki; Yuji Morimoto; Yasuo Tanaka; Taturu Yamauchi, all of Sopporo, Japan

[73] Assignee: Daido Hoxan Inc., Sapporo, Japan

[21] Appl. No.: 640,210

[22] Filed: Apr. 30, 1996

[30] Foreign Application Priority Data

Jun. 29, 1995 [JP] Japan ..... 7-186376

[51] Int. Cl.[6] ..... F25J 3/00

[52] U.S. Cl. ..... 62/620; 62/643; 62/903; 62/905; 165/166; 202/154; 202/158

[58] Field of Search ..... 62/620, 643, 903, 62/905; 165/166; 202/158, 154

[56] References Cited

U.S. PATENT DOCUMENTS

| | | | |
|---|---|---|---|
| 2,919,232 | 12/1959 | Stingley | 202/158 |
| 3,578,073 | 5/1971 | Bosquain | 62/903 |
| 4,606,745 | 8/1986 | Fujita | 62/905 |
| 5,321,954 | 6/1994 | Lehman et al. | 62/903 |

*Primary Examiner*—Ronald C. Capossela

*Attorney, Agent, or Firm*—Jacobson, Price, Holman & Stern, PLLC

[57] ABSTRACT

An improved cryogenic liquefied gas container, or a so-called cold evaporator (CE) for containing a plurality of different liquefied gases such as oxygen and nitrogen gases can be installed on a site with a limited surface area and can store the gases at a substantially equal and constant temperature level to ensure a stable gas supply to consumers that may include medical facilities and manufacturing plants. A plurality of inner tanks 4 are vertically arranged and surrounded by an insulation layer 3 in an outer shell 2 in order to economically utilize the site. The temperature of the high boiling point liquefied gas LG1 contained in the upper inner tank 4*a* and hence the internal pressure of the upper inner tank are stabilized by means of a heat exchanger section 11 to which the low boiling point liquefied gas $LG_2$ in the lower inner tank 4*b* is supplied so that any fluctuations of the internal pressure of the upper inner tank 4*a* due to fluctuating consumption on the part of consumers can be effectively suppressed to consequently ensure a stabilized gas supply.

4 Claims, 4 Drawing Sheets

COLD EVAPORATOR

BACKGROUND OF THE INVENTION

1. Field of the Invention

This invention relates to an improved cryogenic liquefied gas container, or a cold evaporator (hereinafter referred to as CE), to be installed on a site for storing liquefied argon gas, liquefied oxygen gas, liquefied nitrogen gas or liquefied carbon dioxide gas for supplying chemical plants, semiconductor manufacturing plants, argon welding facilities or the like with Ar, $O_2$, $N_2$, $CO_2$ or the like, whichever appropriate or for storing, for example, liquefied oxygen gas and liquefied nitrogen gas, which are fed to an artificial air producing apparatus that mixes them to produce artificial air and feed it to hospitals and other medical facilities for artificial respirators or the like.

2. Prior Art

FIG. 4 of the accompanying drawings schematically illustrates a known CE. Referring to FIG. 4, an outer shell B typically made of rolled steel contains therein an inner tank C typically made of a material that shows satisfactory strength and tenacity and does not become brittle at cryogenic temperature with a vacuum insulation layer D made of a powdery insulating material (e.g., perlite) having a low thermal conductivity interposed therebetween, an inner piping system E linked to the inner tank C being extended to the outside through the vacuum insulating layer D and the outer shell B and coupled to an outer piping system F fitted to the external shell B.

Thus, the inner tank C can store only a type of cryogenic liquefied gas, e.g. liquefied oxygen gas, and therefore, for supplying artificial air, at least a storage tank for storing liquefied oxygen gas and another storage tank for storing liquefied nitrogen gas have to be installed on a given site A. Installing two tanks on a single site is a very space-taking operation and may not be feasible from the viewpoint of availability of land particularly for hospitals located in downtown areas.

With a known CE as described above and illustrated in FIG. 4, the liquefied gas LG brought in by a tank truck is fed into the inner tank C from a feed-in line $L_1$ by way of a liquid inlet valve a of the outer piping system F and lower inner tank pipes $E_1$ and $E_1'$ of the inner piping system E so that the liquefied gas LG may be introduced into the inner tank C both from the bottom and from the top to follow the solid lines in FIG. 4. On the other hand, the liquefied gas LG fed into the inner tank C is made to flow out of the tank through a liquid flow pipe $E_2$ pushed down and dipped into the liquefied gas LG by the pressure of the gas phase G' in the inner tank C then into a gas supply line $L_2$ of the outer piping system F. It is also known that the liquefied gas LG fed into the outer piping system F by way of a liquid feed valve b is gasified by a gas feed evaporator dd and the produced gas G is then further fed to a distribution system by following arrow G having a broken line. An air-warming type evaporator provided with aluminum fins and using air as heat source is typically used for the gas feed evaporator d.

In order to constantly supply gas G to the distribution system, the outer piping system F is provided with a pressurized pipe line $L_3$ of a known type so that the gas pressure in the inner tank C is maintained to a constant level and liquefied gas LG is constantly fed to the liquid flow pipe $E_2$, if the liquefied gas LG in the inner tank C is consumed to reduce the pressure of the gas phase G' in the inner tank C by the operation of feeding gas G through the gas supply line $L_2$.

More specifically, a pressurizing automatic valve e arranged on the pressurized pipe line $L_3$ automatically opens as the pressure of the gas phase G' drops so that liquefied gas LG flowing into the inner tank C through a pressure valve f, the lower inner tank pipe $E_1$ and the bottom of the inner tank C is gasified by a pressurizing evaporator g and the produced pressurized gas by way of a pressure gas valve h of the pressurized pipe line $L_3$ and a pressurizing pipe $E_3$ of the inner tank C.

It may be needless to say that the pressurizing automatic valve e is closed whenever the pressure of the gas phase G regains a predetermined level to keep the pressure to that level. An air-warming type evaporator is typically used for the pressurizing evaporator g. Note that reference symbol i in FIG. 4 denotes a gas outlet valve of the gas supply line $L_2$.

Additionally, a known CE as described above is provided not only with a pressurizing evaporator e for maintaining the internal pressure of the inner tank C to a constant level but also with an economizer valve k and an inner tank safety valve j for dropping the internal pressure of the inner tank C to a predetermined level. Since these components have to be actuated frequently while the cryogenic liquefied gas container is in operation, they claim up to a half of the maintenance efforts to be made for the CE and hence are believed to be subject to a number of improvements.

More specifically, the economizer valve k is connected in series with an economizer check valve m on an economizer line $L_4$ as shown in FIG. 4 and, if the liquefied gas LG in the inner tank C is partly gasified to raise the internal pressure of the inner tank C by heat entering from outside, the gas of the gas phase G' partly flows out from the pressurizing pipe $E_3$ of the inner piping system E along arrow $EG_1$ and then into the inner piping system E by way of the pressure gas valve h, the economizer valve k which is automatically opened and the economizer check valve m, following the route as indicated by arrow $EG_2$ so that it is fed to the gas supply line $L_2$ connected to the distribution system along with liquefied gas LG to consequently drop the internal gas pressure of the gas phase G'.

Additionally, the inner tank safety valve j cannot be used to raise the internal pressure of the inner tank C if no gas is being supplied from the gas supply line $L_2$ to the distribution system or if the economizer valve k is actuated. Thus, it is opened only when the internal pressure of the inner tank C exceeds a predetermined safety level to discharge part of the gas of the gas phase G' in the inner tank C to the outside in order to reduced the internal pressure to a predetermined pressure level.

As will be understood from the above description, when the liquefied gas in the CE is partly discharged for consumption, the internal pressure of the inner tank C falls to lower the temperature of the liquefied gas in the tank so that the pressurizing evaporator g of the pressurized pipe line $L_3$ is actuated to recover the internal pressure to a predetermined level. If no liquefied gas LG is being consumed or it is being consumed at a low consumption rate, the liquefied gas of the CE is partly gasified in the inner tank C to raise the internal pressure thereof.

Thus, the economizer valve k and the inner tank safety valve j are actuated in order for the pressure to recover a predetermined level so that, consequently, at least one of the economizer valve k, the inner tank safety valve j and the pressurizing evaporator e has to be actuated frequently depending on the consumption of liquefied gas of the CD. Note that the pressurizing automatic valve e is typically designed to start operating when the internal pressure of the inner tank C is lower than 5.5 to 6.5 KG/m$^2$, whereas the economizer valve k and the inner tank safety valve j are designed to start operation when the internal pressure exceeds respectively 7.0 to 8.0 KG/m$^2$ and 9.5 to 10.5 KG/m$^2$.

In view of the above problems of known CEs, it is therefore a first object of the invention to provide a CE comprising an outer shell and two or more than two inner tanks arranged vertically with an insulation layer disposed between any two adjacent tanks so that the CE may be installed on a limited area. If a CE comprises vertically arranged two inner tanks, the lower and upper tanks may be used to store oxygen and nitrogen respectively.

It is a second object of the present invention to provide a CE having a configuration as described above and further comprising a thermally conductive support structure connecting the lower and upper inner tanks so that the lower and upper inner tanks may contain a low boiling point liquefied gas and a relatively high boiling point liquefied gas respectively to make the internal pressure of the gas phase in the lower inner tank high and that of the gas phase in the upper inner tank relatively low in order to reduce the liquid temperature difference between the upper and lower inner tanks. As the liquid temperature of the upper inner tank and that of the lower inner tank come close to each other, the internal pressure of the lower inner tank is raised and, therefore, the lower inner tank has to be designed to withstand the internal pressure so that it can support the upper inner tank with a wide margin. Additionally, since the lower inner tank has a large wall thickness, the CE shows the center of gravity at a low position as a whole, which is advantageous from an aseismatic point of view.

Since the upper and lower inner tanks of a CE having a configuration as described above are connected by a thermally conductive support structure, it shows an improved structural strength. When the liquefied gas in the upper inner tank is consumed at an enhanced rate relative to its counterpart in the lower inner tank, the temperature of the liquefied gas in the upper inner tank will also falls to reduce the internal pressure. However, the temperature fall of the inside of the upper inner tank containing a high boiling point liquefied gas is compensated, at least partly, by the relatively high temperature of the lower inner tank containing a low boiling point liquefied gas to make the temperatures of the two inner tanks come close to each other so that the internal pressure of the gas phase of the upper inner tank is prevented from remarkably fluctuating and the rate of operation of the pressurizing evaporator of the outer piping system provided for the upper inner tank may be reduced to improve its durability and make it require less servicing.

It is a third object of the present invention to provide a CE having a configuration as described above and further comprising an inner piping system for a second liquefied gas contained in the lower inner tank and a heat exchanger section arranged in the inside of the upper inner tank so that the low boiling point liquefied gas contained in the lower inner tank may be made to pass through the heat exchanger section. With this arrangement, the temperature of the liquefied gas in the upper inner tank is raised to come close to that of the low boiling point liquefied gas contained in the lower inner tank if it falls undesirably so that it may be held to a constant level and the internal pressure of the gas phase of the container may also be held to a constant level. Consequently, the outer piping system of the upper inner tank may do well without a pressurizing evaporator that has hitherto been regarded as indispensable or, if it is used, its rate of operation may be remarkably reduced.

Finally, it is a fourth object of the present invention to provide a CE having a configuration as described above by referring to the first object of the invention and further comprising an inner piping system for a second liquefied gas contained in the lower inner tank and a heat exchanger section arranged in the inside of the upper inner tank so that the low boiling point liquefied gas contained in the lower inner tank may be made to pass through the heat exchanger section in the upper inner tank and the liquefied gas contained in the upper inner tank may also be made to pass through the other heat exchanger in the lower inner tank through another inner piping system to lower the temperature of the liquefied gas in the lower inner tank and bring it closer to that of its counterpart in the upper inner tank. With this arrangement, the temperature of the liquefied gas in the upper inner tank and that of its counterpart in the lower inner tank can be equalized to constantly maintain the internal pressures of the two tanks to a desired level.

Thus, the economizer valve, the safety valve and the pressurizing automatic valve of the pressurizing evaporator arranged on the CE will be driven less to operate so that these valves may enjoy a longer service life and the safety valve will discharge less gas so that the gases in the CE may be utilized more efficiently and effectively.

SUMMARY OF THE INVENTION

According to a first aspect of the invention, the above first object is achieved by providing a cold evaporator comprising an outer shell and a plurality of inner tanks vertically arranged in the outer shell for containing respective liquefied gases, a thermal insulation layer being disposed between the outer shell and the inner tanks and between any two adjacent inner tanks, each of the inner tanks being provided with an outer piping system arranged outside the outer shell for supplying liquefied gas into the tank and feeding the liquefied gas contained in the tank to a distribution system connected thereto and an inner piping system connecting the outer piping system to the inner tank and extending to the outer shell through the insulation layer.

According to a second aspect of the invention, the above second object is achieved by providing a cold evaporator comprising an outer shell, an upper inner tank arranged in the outer shell for containing a high boiling point liquefied gas and a lower inner tank also arranged in the outer shell below the upper inner tank and connected to the upper inner tank by a thermally conductive support structure for containing a low boiling point liquefied gas, a thermal insulation layer being disposed between the outer shell and the inner tanks and between the upper and lower inner tanks, the upper inner tank being provided with an outer piping system arranged outside the outer shell for supplying the high boiling point liquefied gas into the tank and feeding the liquefied gas contained in the tank to a distribution system connected thereto and an inner piping system connecting the outer piping system to the inner tank and extending to the outer shell through the insulation layer, the lower inner tank being provided with another outer piping system arranged outside the outer shell for supplying the low boiling point liquefied gas into the tank and feeding the liquefied gas contained in the tank to a distribution system connected thereto and an inner piping system connecting the outer piping system to the inner tank and extending to the outer shell through the insulation layer.

According to a third aspect of the invention, the above third object is achieved by providing a cold evaporator comprising an outer shell, an upper inner tank arranged in the outer shell for containing a high boiling point liquefied gas and a lower inner tank also arranged in the outer shell below the upper inner tank and connected to the upper inner tank in an thermally insulated state or by a thermally conductive support structure for containing a low boiling point liquefied gas, a thermal insulation layer being disposed between the outer shell and the inner tanks and between the upper and lower inner tanks, the upper inner tank being provided with an outer piping system arranged outside the outer shell for supplying the high boiling point liquefied gas into the tank and feeding the liquefied gas contained in the tank to a distribution system connected thereto and an inner piping system connecting the outer piping system to the inner tank and extending to the outer shell through the insulation layer, the lower inner tank being provided with another outer piping system arranged outside the outer shell for supplying the low boiling point liquefied gas into the tank and feeding the liquefied gas contained in the tank to a distribution system connected thereto and an inner piping system connecting the outer piping system to the inner tank and extending to the outer shell through the insulation layer, an in-tank pipe of the inner piping system for drawing the low boiling point liquefied gas from the lower inner tank being linked to the gas supply line for delivering the low boiling point gas to the gas distribution by way of the heat exchanger section in the upper inner tank and the insulation layer.

According to a fourth aspect of the invention, the above fourth object is achieved by providing a cold evaporator comprising an outer shell, an upper inner tank arranged in the outer shell for containing a first liquefied gas and a lower inner tank also arranged in the outer shell below the upper inner tank and connected to the upper inner tank by a thermally conductive support structure for containing a second liquefied gas, a thermal insulation layer being disposed between the outer shell and the inner tanks and between the upper and lower inner outer tanks, the upper inner tank being provided with an outer piping system arranged outside the outer shell for supplying the first liquefied gas into the tank and feeding the liquefied gas contained in the tank to a distribution system connected thereto and an inner piping system connecting the outer piping system to the inner tank and extending to the outer shell through the insulation layer, the lower inner tank being provided with another outer piping system arranged outside the outer shell for supplying the second liquefied gas into the tank and feeding the liquefied gas contained in the tank to a distribution system connected thereto and an inner piping system connecting the outer piping system to the inner tank and extending to the outer shell through the insulation layer, an in-tank pipe of the inner piping system for drawing the first liquefied gas from the upper inner tank being linked to the gas supply line for delivering the first gas to the gas distribution by way of the heat exchanger section in the lower inner tank and the insulation layer, an in-tank pipe of the inner piping system for drawing the second liquefied gas from the lower inner tank being linked to the gas supply line for delivering the second liquefied gas to the gas distribution by way of the heat exchanger section in the upper inner tank and the insulation layer.

With a CE according to the first aspect of the invention, since a plurality of inner tanks are vertically arranged in an outer shell, each being surrounded by an insulation layer, and the inner piping systems of the respective tanks are connected to the respective outer piping systems, a plurality of different liquefied gases can be stored on a limited surface area that normally allows an outer shell and a single inner tank contained therein to be installed so that such a CE can remarkably save space.

With a CE according to the second aspect of the invention, since an upper inner tank for storing a high boiling point liquefied gas such as liquefied oxygen gas and a lower inner tank for storing a low boiling point liquefied gas such as liquefied nitrogen gas are vertically arranged within an outer shell and connected with each other by way of a thermally conductive support structure, the internal temperature of the upper inner tank and that of the lower inner tank are made to be close to each other by the thermally conductive support structure so that, consequently, the internal pressure of the lower inner tank is normally held higher than the internal pressure of the upper inner tank. Thus, the lower inner tank is designed to adapt itself to such a high internal pressure and hence have a large wall thickness so that the lower inner tank can bear the weight of the upper inner tank by a large margin and the CE as a whole shows a low center of gravity and good aseismatic properties.

Additionally, since the upper and lower inner tanks are coupled by way of a thermally conductive support structure, the overall structure of the CE is strengthened and the temperature of the high boiling point liquefied gas contained in the upper inner tank can be raised to some extent by the low boiling point liquefied gas in the lower inner tank. Thus, the internal temperature and hence the pressure of the gas phase of the upper inner tank can be prevented from fluctuating to some extent by the gas phase of the lower inner tank and the internal temperature of the upper inner tank and that of the lower inner tank are brought close to each other so that consequently the pressurizing evaporator of the outer piping system of the upper inner tank is triggered to operate less frequently to make the pressurized pipe line of the outer piping system enjoy a prolonged service life and a reduced frequency of servicing.

With a CE according to the third aspect of the invention, the internal temperature of the upper inner tank and that of the lower inner tank are made to come to close to each other not by a thermally conductive support structure as in the case of a CE according to the second aspect of the invention but by causing the liquefied gas in the lower inner tank to flow into the upper inner tank by way of a heat exchanger in order to improve the efficiency of equalizing the two temperatures. Thus, a CE according to the third aspect of the invention more efficiently than a CE according to the second aspect of the invention in terms of the operation of bringing the internal temperatures of the upper and lower inner tanks closer. Additionally, by maintaining the internal pressure in the lower inner tank to an appropriate level by means of the pressurizing evaporator of the outer piping system, the effect of equalizing the internal temperatures of the upper and lower inner tanks can be further improved, because the internal temperature of the lower inner tank can be controlled by the internal pressure of the tank. Consequently, the internal pressure of the upper inner tank is also stabilized to by turn stabilize the gas supply to the distribution system so that the pressurizing evaporator of the outer piping system of the upper inner tank may be omitted or, if not, its rate of operation may be significantly reduced.

A CE according to the fourth aspect of the invention is particularly advantageous when the liquefied gas of the upper inner tank and that of the lower inner tank are consumed respectively at significantly different consumption rates or when only the liquefied gas of either one of the inner tanks is consumed for the reasons as will be described hereinafter. For instance, if the liquefied gas in the upper inner tank is oxygen and the gas in the lower inner tank is nitrogen and they are fed to an artificial air producing apparatus, $O_2$ and $N_2$ are consumed at a ratio of 1:4 so that the internal pressure of the upper inner tank containing $O_2$ is held relatively high to make the internal temperature of the the tank considerably higher than that of the lower inner tank containing $N_2$. However, with a CE according to the fourth aspect of the invention, the liquefied oxygen gas in the upper inner tank is fed to the mixer of the artificial air producing apparatus after passing through the heat exchanger of the lower inner tank to raise the temperature of the liquefied nitrogen gas in the lower inner tank, while the liquefied nitrogen gas in the lower inner tank is fed to the mixer after passing through the heat exchanger of the liquefied oxygen gas in the upper inner tank.

As a result, the temperature of the liquefied oxygen gas in the upper inner tank is brought closer to that of the liquefied nitrogen gas in the lower inner tank to make the economizer valve of the upper inner tank triggered to operate less frequently and, at the same time, the load of the pressurizing evaporator of the lower inner tank is reduced. It may be understood that, if the artificial air producing apparatus is replaced by a high pressure oxygen therapeutic apparatus, the above consumption ratio of oxygen and nitrogen will inverted, although the CE operates effectively and efficiently as well.

If, on the other hand, only one of the liquefied gases contained in the upper and lower inner tanks is consumed, the internal pressure of the inner tank from which no liquefied gas is consumed will become high relative to that of the other inner tank but the internal temperature of that inner tank will be lowered by the liquefied gas contained in the inner tank and being consumed so that, consequently, the safety valve of the inner tank will be triggered to operate less frequently and hence requires less servicing to improve its durability.

DETAILED DESCRIPTION OF THE PREFERRED EMBODIMENTS

Figure 1:
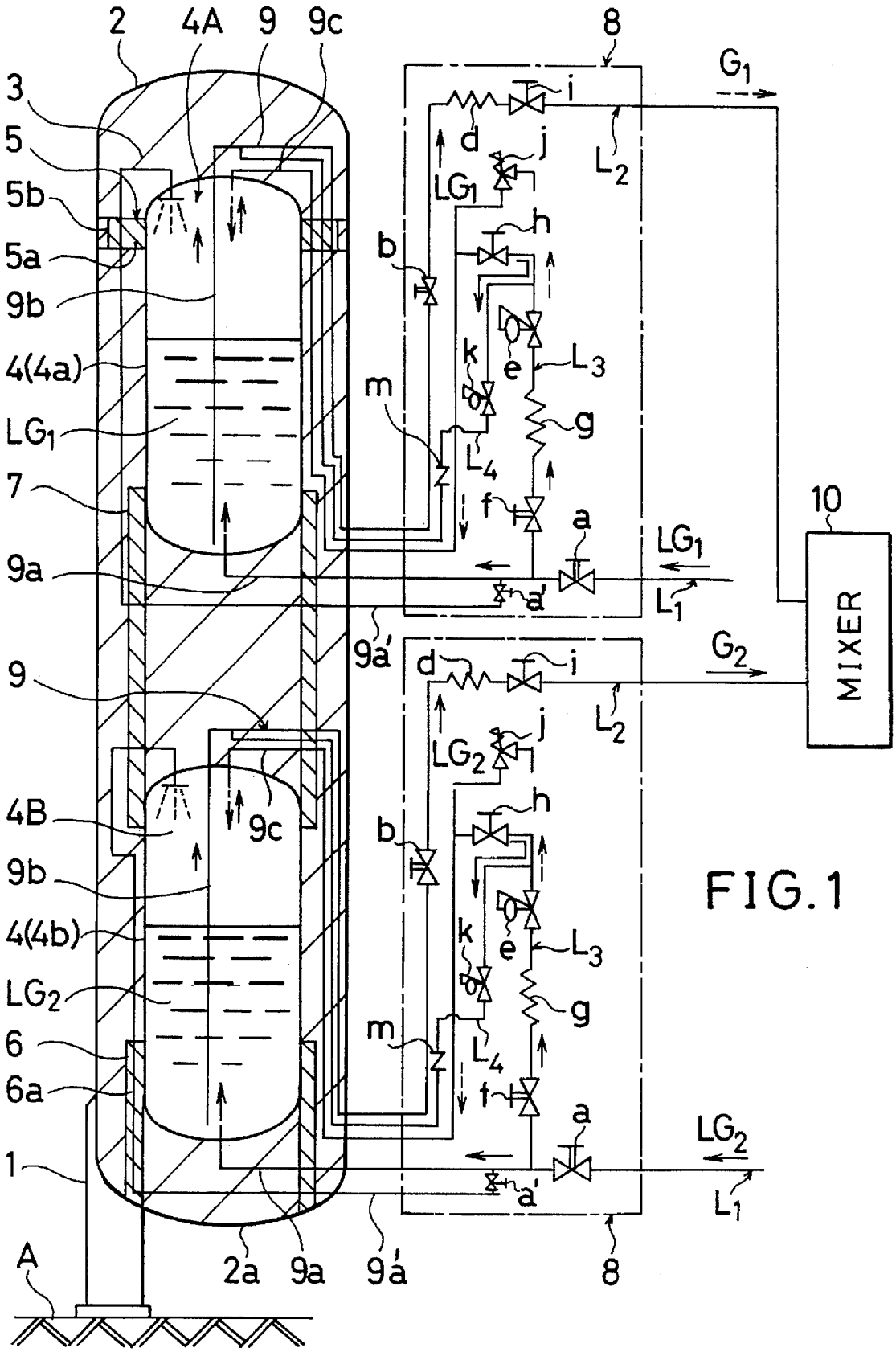
FIG. 1 is a schematic cross sectional front view of a first embodiment of CE according to the first and second aspects of the invention, illustrating its operation.

Now, the present invention with be described by referring to the accompanying drawings that illustrate preferred embodiments of the invention. Referring firstly to FIG. 1 illustrating a first embodiment, it comprises an outer shell 2 standing on its bottom 2*a* and supported by a base stand 1 on a site A and a number of (two) vertically arranged inner tanks 4, 4 that are separated from each other by an insulation layer 3. In FIG. 1, reference numerals 9 and 6 respectively denote an upper inner tank support structure and a lower inner tank support structure and reference numeral 7 denotes a thermally conductive support structure disposed between the inner tanks. In the illustrated embodiment, the inner tank support structure 9 comprises a metal structure 9*a* rigidly fitted to the inner tank 4 and an insulation member 5*b* typically made of bakelite and supported by the outer shell 2, whereas the inner tank support structure 6 comprises a metal member 6*a* secured to the lowermost inner tank 4.

Figure 4:
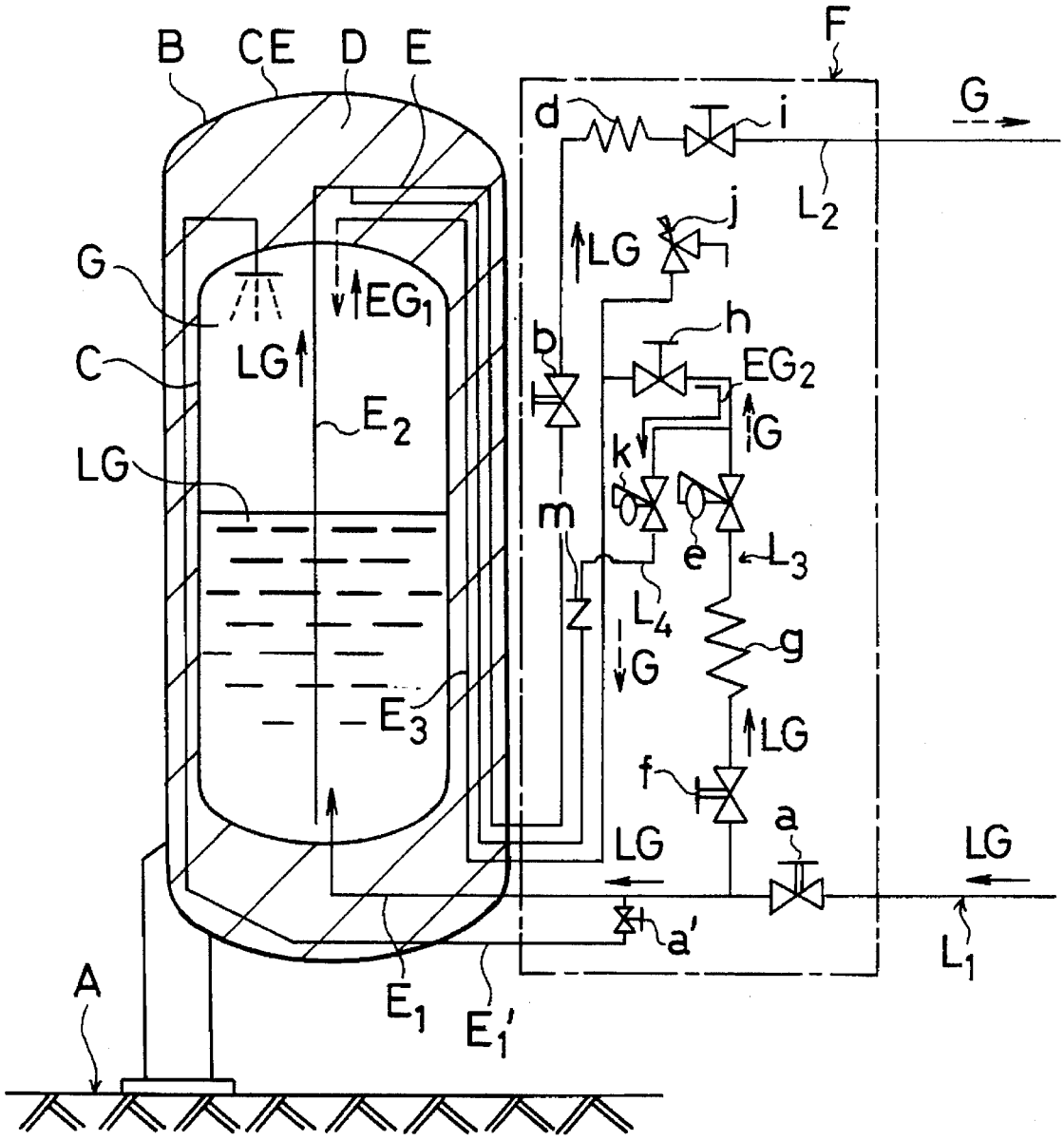
FIG. 4 PRIOR ART
FIG. 4 is a schematic cross sectional front view of a known CE, illustrating its operation.

Note that the illustrated embodiment comprises only two vertically arranged inner tanks 4, 4 that are provided on the outside of the outer shell 2 with respective outer piping systems 8, 8, each of which has a configuration similar to the piping system F of the known CE described earlier by referring to FIG. 4. The components of the outer piping systems that are similar to their counterparts of the known CE are denoted by the same reference symbols. More specifically, each of the outer piping systems comprises a feed-in line $L_1$, a gas supply line $L_2$ and pressurized pipe line $L_3$ and connected to an inner piping system 9 that couples the outer piping system 8 to the corresponding inner tank 4 and extends through an insulation layer 3 to the outer shell 3.

Also as described earlier by referring to the known CE, liquefied gases $G_1$ and $G_2$ such as liquefied oxygen gas and liquefied nitrogen gas can be fed respectively into the upper and lower inner tanks 4, 4 by way of the respective feed-in lines $L_1$, $L_1$ and fed out to a distribution system 10 connected thereto by way of the respective gas supply lines $L_2$, $L_2$. Note that the components of the feed-in line $L_1$, the gas supply line $L_2$ and the pressurized pipe line $L_3$ of each of the outer piping systems 8, 8 are denoted by the respective reference symbols that are same as those of the known CE. Each of the feed-in lines $L_1$, $L_1$ is provided with liquid inlet valves a, a', which are respectively connected to lower in-tank pipes 9*a*, 9*a'* of the inner piping system 9 extending respectively through the bottom and an upper portion of the corresponding inner tank 4.

Additionally, as in the case of the known CE, each of the gas supply lines $L_2$, $L_2$ is provided with a gas outlet valve i, a gas feed evaporator d and a liquid feed valve b and disposed through the ceiling section of the corresponding inner tank 4 so as to communicate with a liquid-dipping pipe 9*b* of the inner piping system 9 dipped into the liquefied gas $LG_1$ or $LG_2$ whichever appropriate. On the other hand, each of the pressurized pipe lines $L_3$, $L_3$ is provided with a pressure valve f, a pressurizing evaporator g, a pressurizing automatic valve e, a pressure gas valve h and an inner tank safety valve j and held in communication with the gas phase 4A or 4B which ever appropriate through the ceiling section of the corresponding inner tank 4 by way of a pressurizing in-tank pipe 9*c* of the corresponding inner piping system 9. The outer piping systems 8, 8 and the inner piping systems 9, 9 of this embodiment operate substantially similar to their counterparts of the above described known CE.

Although the inner tank support structures 5 and 6 are not indispensable, they are preferably used to improve the strength and the stability of the respective tanks. Thus, the above described embodiment of CE according to the first aspect of the invention is remarkably space saving and can be installed on a site having a limited surface area. An embodiment of CE according to the second aspect of the invention as will be described hereinafter differs from the above embodiment in that the upper inner tank 4*a* and the lower inner tank 4*b* contained in the outer shell 2 of the latter embodiment are mutually connected by means of a thermally conductive support structure 7 and that upper inner tank 4*a* is designed to store a high boiling point liquefied gas such as liquefied oxygen gas where the lower inner tank 4*b* is designed to store a low boiling point liquefied gas such as liquefied nitrogen gas. Otherwise, these embodiments are absolutely identical.

In the embodiment of CE according to the second aspect of the invention, as shown in FIG. 1 of the accompanying drawings, the upper inner tank 4a and the lower inner tank 4b are mutually connected by means of a thermally conductive support structure 7 disposed between them and made of metal or some other appropriate material, which not only reinforces the strength of the entire CE but also serves to heat or cool the upper inner tank 4a by the liquefied gas stored in the lower inner tank 4b.

Thus, the temperature of the upper inner tank 4a is stabilized by the liquefied gas stored in the lower inner tank 4b and the temperature of the liquefied gas stored in the upper inner tank 4a is brought closer to that of the liquefied gas stored in the lower inner tank 4b so that consequently the internal pressure of the lower inner tank 4b or the pressure of the gas phase 4A in the lower inner tank 4b is brought up. Since the inner tanks are designed in view of this fact, the lower inner tank 4b is made to have a wall thickness greater than that of the upper inner tank 4a. Thus, the center of gravity of the CE is located low to make the CE structural advantages including excellent structural stability.

Additionally, since the pressure of the gas phase 4A in the upper upper inner tank 4a does not fluctuate significantly because of the above described stabilized temperature, the economizer valve k and other valves of the economizer pipe line L4 of the surer piping system 8 of the upper inner tank is not triggered to operate very frequently as long as the high boiling point liquefied gas in the upper inner tank 4a is not consumed at an enhanced rate and therefore its temperature does not rise remarkably. Thus, the valves of economizer line $L_4$ will show a long service life to improve the efficiency of the CE as a whole.

If the liquefied gas stored in the upper inner tank 4a is consumed at a high rate, it is warmed by the liquefied gas in the lower inner tank 4b so that the frequency of operation of the pressurizing evaporator g and other related components of the pressurized pipe line $L_3$ will be reduced.

Now, a third embodiment of CE according to the third aspect of the invention will be described by referring to FIG. 2. Here again, the upper inner tank 4a and the lower inner tank 4b may be separated by an insulation layer 3 or connected by means of a thermally conductive support structure 7 as shown in FIG. 1.

What is remarkable about the third embodiment is that the liquid-dipping pipe 9b of the inner piping system 9 for drawing a low boiling point liquefied gas $LG_2$ stored in the lower inner tank 4b is not directly connected to the gas supply line $L_2$ of the outer piping system 8 but connected to another pipe 9d, which is drawn into the upper inner tank 4a storing a high boiling point liquefied gas LG1 and then drawn out into the insulation layer 3 by way of a heat exchanger section 11 disposed in the upper inner tank 4a before it is connected to the gas supply line $L_2$.

Figure 2:
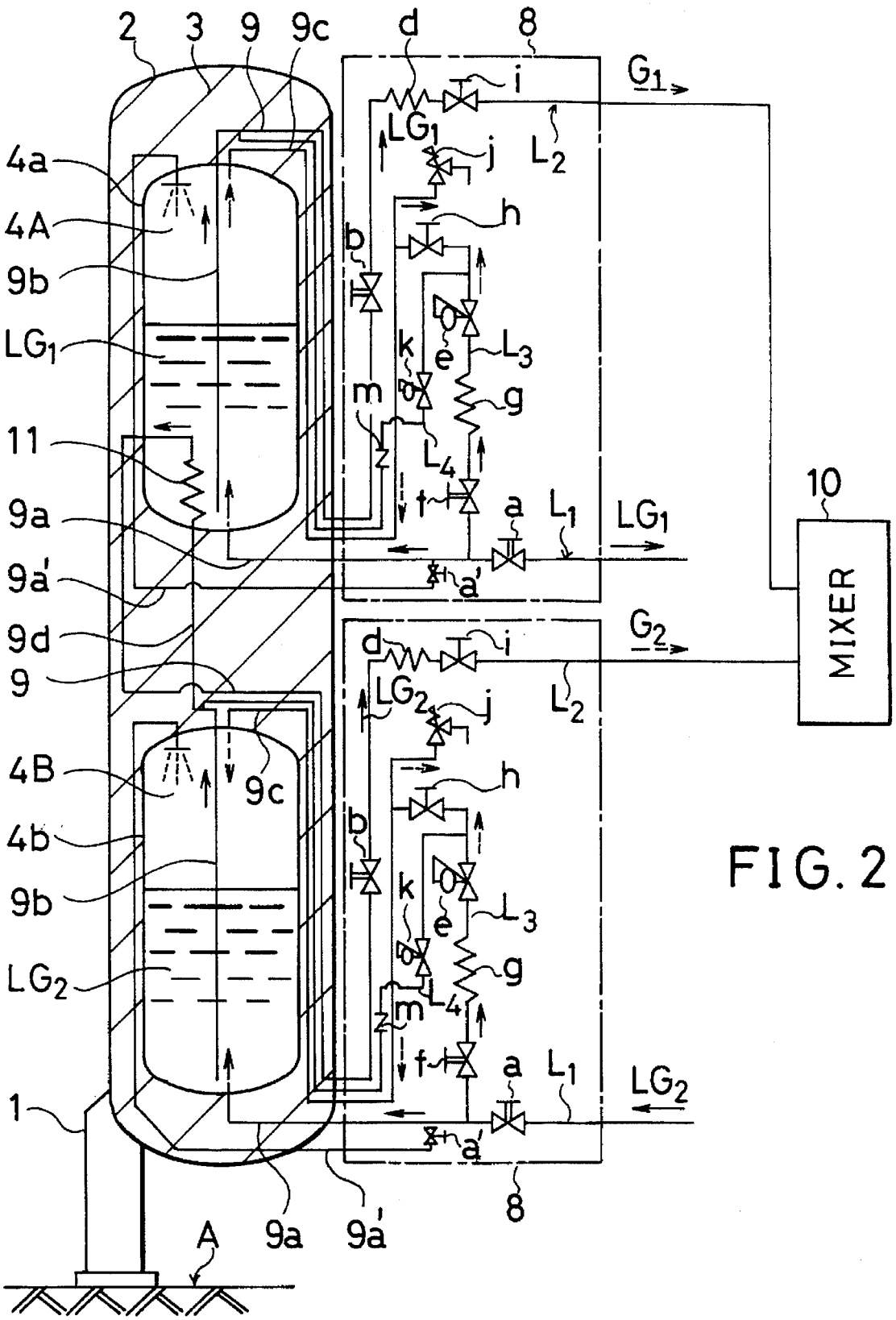
FIG. 2 is a schematic cross sectional front view of a third embodiment of CE according to the third aspect of the invention, illustrating its operation.

The heat exchanger section 11 may he dipped into the liquefied gas $LG_1$ in the upper inner tank 4a as shown in FIG. 2 or arranged in the gas phase 4A. Alternatively, it may be so arranged as to bridge the liquefied gas $LG_1$ and the gas phase 4A.

With the above described arrangement of the third embodiment, the liquefied gas $LG_1$ stored in the upper inner tank 4a is warmed or cooled by the low boiling point liquefied gas $LG_2$ in the lower inner tank 4b to become closer to the latter in terms of temperature so that the pressure of the gas phase 4A in the upper inner tank 4a is stabilized as it is prevented from rising and falling significantly. Thus, with this embodiment, the pressure of the gas phase 4A may be held to a constant level if the pressurized pipe line $L_3$ comprising a pressurizing evaporator g and the economizer pipe line $L_4$ comprising an economizer valve k that has hitherto been believed to be indispensable for the outer piping system 8 of the upper inner tank 4a are omitted so that gases may be delivered to the distribution line on a stable basis. If the pressurized pipe line $L_3$ and the economizer pipe line $L_4$ are left in place, the pressurizing evaporator g, the pressurizing automatic valve e and the economizer valve k may not be operated frequently.

Thus, it will be seen that this embodiment is particularly advantageous in such a case where the upper inner tank 4a is used to store liquefied oxygen gas and the lower inner tank 4b stores liquefied nitrogen gas and the CE is designed to deliver artificial air to the distribution system 10 that may be connected to hospitals because the rate of oxygen gas consumption is about ¼ of the consumption rate of nitrogen gas but the temperature of the liquefied oxygen gas is maintained to the temperature level of the liquefied nitrogen gas and prevented from evaporating if the liquefied oxygen gas in the upper inner tank 4a is warmed by external heat so that the internal pressure of the upper inner tank 4a does not rise significantly and hence the economizer valve k of the outer piping system of the upper inner tank 4a may not be triggered frequently for operation in order to ensure a stable supply of oxygen gas. If, conversely, the liquefied oxygen gas is consumed at an enhanced rate for some reason, it is warmed by the liquefied nitrogen gas in the lower inner tank 4a so that the pressurizing evaporator g may not be operated frequently to ensure a stable supply of oxygen gas. In an experiment using upper and lower inner tanks with a capacity of 2,500 $m^3$, storing respectively liquefied oxygen gas and liquefied nitrogen gas that are held to −157° C., it was found that the internal pressure of the upper inner tank was 7 $kgf/cm^2$, while that of the lower inner tank was 20 $kgf/cm^2$.

When a thermally conductive support structure 7A is provided, any possible temperature rise in the liquefied gas $LG_1$ stored in the upper inner tank 4a is prevented from taking place by the low temperature liquefied gas in the lower inner tank 4b and the thermally conductive support structure 7 even if the liquefied gas $LG_2$ stored in the lower inner tank 4b does not flow through the heat exchanger section 11 because no gas G2 is supplied to the distribution system 10. Note that the heat exchanger section 11 may be arranged not in the liquid phase but in the gas phase in the upper inner tank 4a.

Figure 3:
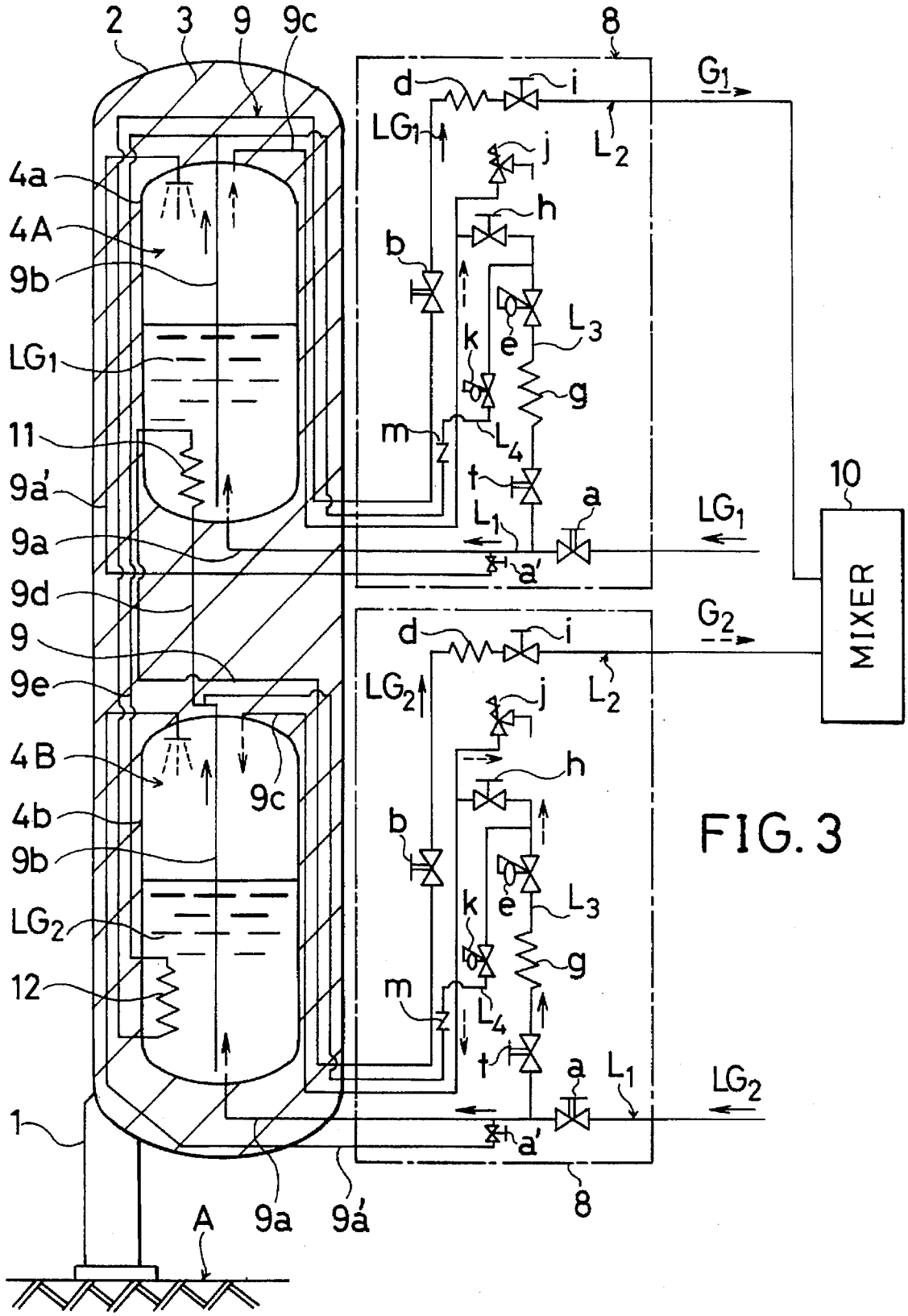
FIG. 3 is a schematic cross sectional front view of a fourth embodiment of CE according to the fourth aspect of the invention, illustrating its operation.

Now, a fourth embodiment of CE according to the invention will be described by referring to FIG. 3. Like the first and second embodiments, it comprises an outer shell. 2, an upper inner tank 4a for storing a liquefied gas $LG_1$ and a lower inner tank 4b for storing another liquefied gas $LG_2$, the upper and lower inner tanks being surrounded by an insulation layer 3. The upper and lower inner tanks 4a and 4b are provided respectively with outer piping systems 8, 8 for feeding the inner tanks 4a, 4b with liquefied gases $LG_1$, $LG_2$ and supplying gases $G_1$, $G_2$ to a distribution system connected thereto and inner piping systems 9, 9 for connecting the inner tanks 4a, 4b and the respective outer piping systems 9, 9 so that the gases are drawn out of the outer shell 2 by way of the insulation layer 3.

The fourth embodiment is different from the preceding embodiments in that the liquid-dipping pipe 9b of the inner piping system 9 of the upper inner tank 4a for drawing liquefied gas $LG_1$ out of the upper inner tank 4a is not directly connected to the gas supply line $L_2$ of the corresponding outer piping system 8 but feeds the liquefied gas $LG_1$ it has taken up from the upper inner tank 4a to a heat exchanger section arranged in the lower inner tank 4b by way of another pipe 9e disposed in the insulation layer 3 of the outer shell 2 and then further to the gas supply line $L_2$ connected to the distribution system by way of the inner piping system 9 disposed in the insulation layer 3 in order to deliver gas $G_1$. Note that reference symbol L4 in FIG. 3 denotes an economizer pipe line of a conventional type as described earlier by referring to FIG. 4, which is connected to the inner piping system 9 of the upper inner tank 4a and held in communication with the gas phase 4A of the upper inner tank 4a and also with the upstream end of the gas supply line $L_2$. Reference symbols k and m respectively denote an economizer valve and an economizer check valve connected in series in the economizer pipe line $L_4$.

The fourth embodiment is provided not only with the above described heat exchanger section 12 but also with another heat exchanger section 11, which is identical with its counterpart of the third embodiment and arranged in the upper inner tank 4a so that the liquefied gas $LG_2$ drawn out fed of the lower inner tank 4b by way of the liquid-dipping pipe 9b is led to the gas supply line $L_2$ of the outer piping system 8 by way of the pipe 9d for liquefied gas $LG_2$ and the inner piping system 9 of the lower inner tank 4b. As described above, reference symbols L4, k and m in FIG. 4 respectively denote an economizer pipe line, an economizer valve and an economizer check valve of the lower inner tank 4b.

With the above described arrangement, if the liquefied oxygen gas stored in the upper inner tank 4a is consumed at a consumption rate lower than that of the liquefied nitrogen gas stored in the lower inner tank 4b, the temperature of the liquefied nitrogen gas in the lower inner tank 4b falls as a result of the reduced internal pressure but is warmed by the liquefied oxygen gas whose temperature has risen as a result of a raised internal pressure there by way of the heat exchanger 12 so that nitrogen gas produced by the liquefied nitrogen gas in the lower inner tank 4b is sufficiently supplied to the mixer 10 of the artificial air producing apparatus on a stable basis.

Additionally, since the fourth embodiment comprises not only the heat exchanger section 12 but also the heat exchanger section 11 arranged in the upper inner tank 4a, the liquefied nitrogen gas in the lower inner tank 4b can cool the liquefied oxygen gas in the upper inner tank 4a before oxygen gas is fed to the mixer 10 and maintain the temperature of the upper inner tank 4a always close to that of the lower inner tank 4b so that consequently both the frequency of operation of the economizer valve k of the upper inner tank 4a and that of the pressurizing evaporator e of the lower inner tank can he significantly reduced.

If the fourth embodiment is connected not to an artificial air producing apparatus but to a high pressure oxygen therapeutic apparatus, it will operate equally effectively and efficiently. If only either the liquefied oxygen gas or the liquefied nitrogen gas is consumed, any temperature rise on the part of the inner tank containing the unconsumed liquefied gas can be compensated by the temperature fall on the part of the inner tank containing the consumed liquefied gas so that the frequency of operation of the inner tank safety valve j can be remarkable reduced.

[Advantages of the Invention]

With a CE according to the first aspect of the invention, a plurality of different liquefied gases can be stored on a limited surface area that normally allows an outer shell and a single inner tank contained therein to be installed so that such a CE can remarkably save space. With a CE according to the second aspect of the invention, since an upper inner tank for storing a high boiling point liquefied gas and a lower inner tank for storing a low boiling point liquefied gas are vertically arranged within an outer shell and connected with each other by way of a thermally conductive support structure, the internal temperature of the upper inner tank and that of the lower inner tank are made to be close to each other by the thermally conductive support structure so that, consequently, the internal pressure of the lower inner tank is normally held higher than the internal pressure of the upper inner tank. Thus, the lower inner tank is designed to adapt itself to such a high internal pressure and hence have a large wall thickness so that the lower inner tank can bear the weight of the upper inner tank by a large margin and the CE as a whole shows a low center of gravity and good aseismatic properties. Additionally, since the temperature of the high boiling point liquefied gas contained in the upper inner tank can be raised to some extent by the low boiling point liquefied gas in the lower inner tank, the internal temperature of the upper inner tank and that of the lower inner tank are brought close to each other to achieve a thermally stabilized condition so that consequently the pressurizing evaporator, the pressurizing automatic valve and the economizer valve of the outerpiping system of the upper inner tank provided for the stabilization of pressure may be less triggered for operation to enhance their service life.

With a CE according to the third aspect of the invention, the internal temperature of the upper inner tank and that of the lower inner tank are made to come to close to each other not by a thermally conductive support structure as in the case of a CE according to the second aspect of the invention but by causing the liquefied gas in the lower inner tank to flow into the upper inner tank by way of a heat exchanger in order to improve the efficiency of equalizing the two temperatures. Consequently, the internal pressure of the upper inner tank is also stabilized to by turn stabilize the gas supply to the distribution system so that the rate of operation of the pressurizing evaporator, the pressurizing automatic valve and the economizer valve of the outer piping system of the upper inner tank may be significantly reduced to save servicing efforts.

Since the two inner tanks of a CE according to the fourth aspect of the invention is provided with respective heat exchangers, the temperature of the liquefied oxygen gas in the upper inner tank is brought even closer to that of the liquefied nitrogen gas in the lower inner tank to make the, safety valve, the economizer valve and the pressurizing evaporator triggered to operate less frequently and hence prolong their service life as these components conventionally occupy most of the maintenance efforts required for the CE. Additionally, since the safety valve is operated less frequently, the rate of discharge of gas waste is significantly reduced and the liquefied gases contained in the CE can be stored for a long period of time.

It will be understood that, if the ratio between the consumption rate of the liquefied gas in the upper inner tank and that of the liquefied gas in the lower inner tank is always held constant, the economizer valve of the upper inner tank and the pressurizing evaporator of the lower inner tank may be omitted without damaging the efficiency of operation of the CE.

What is claimed is:

1. A cold evaporator characterized in that it comprises an outer shell and a plurality of inner tanks vertically arranged in the outer shell for containing respective liquefied gases, a thermal insulation layer being disposed between the outer shell and the inner tanks and between any two adjacent inner tanks, each of the inner tanks being provided with an outer piping system arranged outside the outer shell for supplying liquefied gas into the tank and feeding the liquefied gas contained in the tank to a distribution system connected thereto and an inner piping system connecting the outer piping system to the inner tank and extending to the outer shell through the insulation layer.

2. A cold evaporator characterized in that it comprises an outer shell, an upper inner tank arranged in the outer shell for containing a high boiling point liquefied gas and a lower inner tank also arranged in the outer shell below the upper inner tank and connected to the upper inner tank by a thermally conductive support structure for containing a low boiling point liquefied gas, a thermal insulation layer being disposed between the outer shell and the inner tanks and between the upper and lower inner tanks, the upper inner tank being provided with an outer piping system arranged outside the outer shell for supplying the high boiling point liquefied gas into the tank and feeding the liquefied gas contained in the tank to a distribution system connected thereto and an inner piping system connecting the outer piping system to the inner tank and extending to the outer shell through the insulation layer, the lower inner tank being provided with another outer piping system arranged outside the outer shell for supplying the low boiling point liquefied gas into the tank and feeding the liquefied gas contained in the tank to a distribution system connected thereto and an inner piping system connecting the outer piping system to the inner tank and extending to the outer shell through the insulation layer.

3. A cold evaporator characterized in that it comprises an outer shell, an upper inner tank arranged in the outer shell for containing a high boiling point liquefied gas and a lower inner tank also arranged in the outer shell below the upper inner tank and connected to the upper inner tank in an thermally insulated state or by a thermally conductive support structure for containing a low boiling point liquefied gas, a thermal insulation layer being disposed between the outer shell and the inner tanks and between the upper and lower inner tanks, the upper inner tank being provided with an outer piping system arranged outside the outer shell for supplying the high boiling point liquefied gas into the tank and feeding the liquefied gas contained in the tank to a distribution system connected thereto and an inner piping system connecting the outer piping system to the inner tank and extending to the outer shell through the insulation layer, the lower inner tank being provided with another outer piping system arranged outside the outer shell for supplying the low boiling point liquefied gas into the tank and feeding the liquefied gas contained in the tank to a distribution system connected thereto and an inner piping system connecting the outer piping system to the inner tank and extending to the outer shell through the insulation layer, an in-tank pipe of the inner piping system for drawing the low boiling point liquefied gas from the lower inner tank being linked to the gas supply line for delivering the low boiling point gas to the gas distribution by way of the heat exchanger section in the upper inner tank and the insulation layer.

4. A cold evaporator characterized in that it comprises an outer shell, an upper inner tank arranged in the outer shell for containing a first liquefied gas and a lower inner tank also arranged in the outer shell below the upper inner tank and connected to the upper inner tank by a thermally conductive support structure for containing a second liquefied gas, a thermal insulation layer being disposed between the outer shell and the inner tanks and between the upper and lower inner tanks, the upper inner tank being provided with an outer piping system arranged outside the outer shell for supplying the first liquefied gas into the tank and feeding the liquefied gas contained in the tank to a distribution system connected thereto and an inner piping system connecting the outer piping system to the inner tank and extending to the outer shell through the insulation layer, the lower inner tank being provided with another outer piping system arranged outside the outer shell for supplying the second liquefied gas into the tank and feeding the liquefied gas contained in the tank to a distribution system connected connected thereto and an inner piping system connecting the outer piping system to the inner tank and extending to the outer shell through the insulation layer, an in-tank pipe of the inner piping system for drawing the first liquefied gas from the upper inner tank being linked to the gas supply line for delivering the first gas to the gas distribution by way of the heat exchanger section in the lower inner tank and the insulation layer, an in-tank pipe of the inner piping system for drawing the second liquefied gas from the lower inner tank being linked to the gas supply line for delivering the second liquefied gas to the gas distribution by way of the heat exchanger section in the upper inner tank and the insulation layer.

* * * * *